US005348499A

United States Patent [19]

Torigai et al.

[11] Patent Number: 5,348,499

[45] Date of Patent: Sep. 20, 1994

[54] OUTBOARD MOTOR

[75] Inventors: Katsumi Torigai; Masanori Takahashi; Yoshihide Hirano, all of Hamamatsu, Japan

[73] Assignee: Sanshin Kogyo Kabushiki Kaisha, Hamamatsu, Japan

[21] Appl. No.: 907,387

[22] Filed: Jul. 1, 1992

[30] Foreign Application Priority Data

Sep. 3, 1991 [JP] Japan ..... 3-248486

[51] Int. Cl.[5] ..... B63H 21/26

[52] U.S. Cl. ..... 440/76; 440/88; 123/195 P

[58] Field of Search ..... 440/49, 53, 76, 77, 440/78, 88, 89, 113, 900; 123/253, 65 R, 73 A, 73 C, 74 R, 195 P

[56] References Cited

U.S. PATENT DOCUMENTS

| | | | |
|---|---|---|---|
| Re. 32,620 | 3/1988 | Iwai | 440/77 |
| 2,460,419 | 2/1949 | Kincannon | 440/77 |
| 4,692,123 | 9/1987 | Tada et al. | 440/77 |
| 5,041,034 | 8/1991 | Sakamoto | 440/76 |

*Primary Examiner*—Stephen P. Avila

*Attorney, Agent, or Firm*—Knobbe, Martens, Olson & Bear

[57] ABSTRACT

Several embodiments of induction systems for two cycle, crankcase compression, internal combustion engines employed for powering outboard motors. The outboard motor is supported for tilt and trim movement and the induction system is designed so as to extend from the intake ports of the engine in a generally rearward direction so as to be substantially unaffected by changes in trim angle and acceleration. The invention is described in conjunction with both V-type and inline type of engines.

24 Claims, 5 Drawing Sheets

OUTBOARD MOTOR

BACKGROUND OF THE INVENTION

This invention relates to an outboard motor and more particularly to an improved induction system for an outboard motor.

It is well known that outboard motors normally have their powering internal combustion engines disposed so that the engine crankshaft rotates about a generally vertically extending axis. Conventionally, the internal combustion engine is disposed so that the crankshaft is relatively closely positioned to the transom and the cylinders extend rearwardly from the crankshaft. When the powering internal combustion engine is of the two cycle type, as is conventional with outboard motor practice, the intake charge is delivered to the crankcase chambers of the engine. This means that the induction system extends forwardly from the crankcase chambers and this gives rise to certain problems.

Specifically, it is well known that an outboard motor is mounted on the transom for tilt and trim movement and the trim angle of the outboard motor relative to the transom is changed depending upon the running speed of the engine. Hence, if the outboard motor is operated in a trimmed up condition, the induction passages will be generally upwardly inclined from their inlet ends to their discharge ends where they communicate with the crankcase chambers. This upward inclination can have a tendency to cause fuel which may condense and collect in the induction system and to flow forwardly toward the inlet opening. Hence, when the outboard motor is trimmed down or if acceleration occurs from an idle condition, this forwardly collected fuel will run rearwardly into the engine and cause a temporary overrich condition. This can provide, at the minimum, a problem with hydro carbon emissions and at the worst, plug fouling, irregular running and in extreme cases even stalling.

It is, therefore, a principal object to the invention to provide an improved induction system for an outboard motor.

It is a further object to this invention to provide an induction system for the crankcase compression, two cycle internal combustion engine of an outboard motor wherein the effects of trim adjustment or acceleration will not significantly change the fuel/air ratio delivered to the engine, particularly during transient conditions.

SUMMARY OF THE INVENTION

This invention is adapted to be embodied in an outboard motor that is adapted to be affixed for tilt and trim movement at a forward point of the outboard motor relative to the hull of an associated watercraft. The outboard motor includes a power head containing a two cycle, crankcase compression, internal combustion engine. The engine comprises a crankcase positioned forwardly in the power head and adapted to rotatably support a crankshaft. A cylinder extends generally rearwardly from the crankcase and contains a piston for driving the crankshaft. An intake port is provided for admitting a charge to the crankcase and, in accordance with the invention, an intake pipe is connected at its outlet end to the intake port and extends generally rearwardly therefrom.

DETAILED DESCRIPTION OF THE PREFERRED EMBODIMENTS OF THE INVENTION

Figure 1:
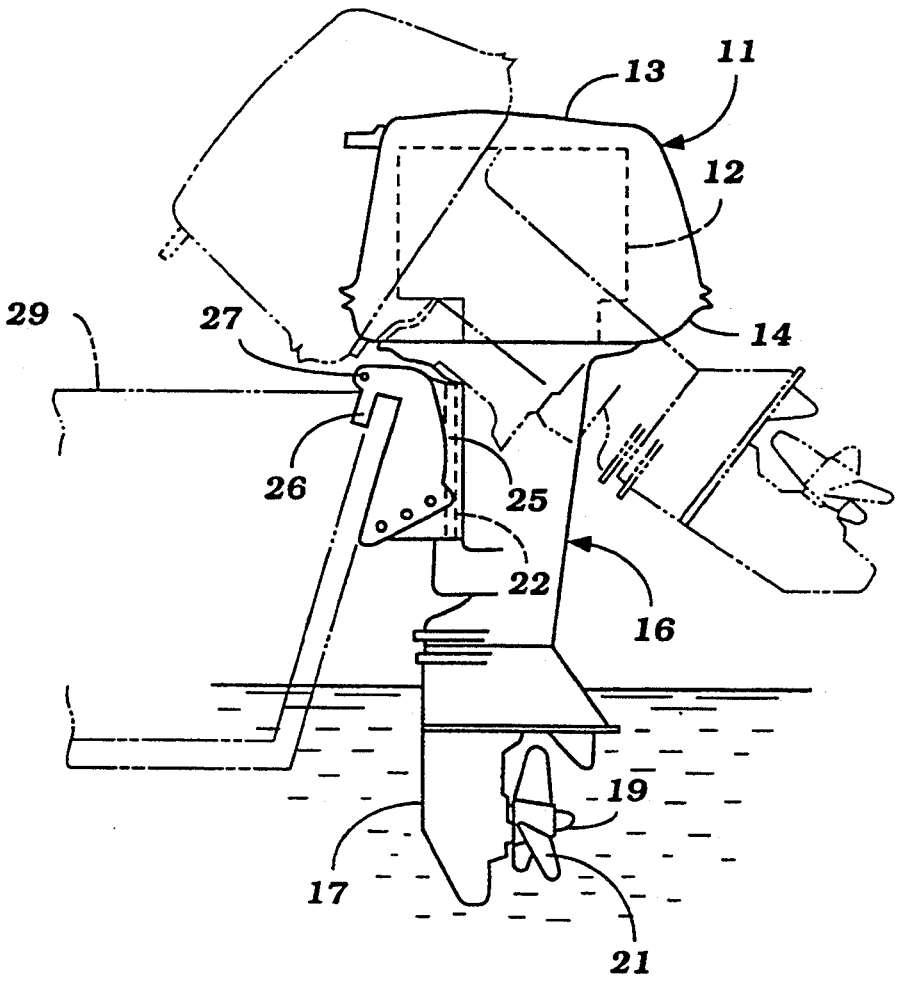
FIG. 1 is a side elevational view of an outboard motor constructed in accordance with an embodiment of invention, as attached to the transom of an associated watercraft, show in phantom. In this figure, the outboard motor is shown in solid lines in its tilting down operational position and in phantom lines in a tilted up, out-of-the water position.

Referring now in detail to the drawings and initially to FIG. 1, an outboard motor is depicted and identified generally by the reference numeral 11. The outboard motor 11 includes a power head that is comprised of a powering internal combustion engine, indicated generally by the reference numeral 12 and which is surrounded by a protective cowling, comprised of a main cowling member 13 detachably connected to a tray 14.

As will become apparent as this description proceeds, the engine 12 is supported so that its output shaft rotates about a vertically extending axis. This engine output shaft is connected to a drive shaft that is journalled for rotation about a vertically extending axis in a drive shaft housing 16 that depends from the tray 14. This drive shaft 15 depends into a lower unit 17 in which a conventional forward, neutral, reverse bevel gear transmission is incorporated for selectively driving a propeller shaft 19 in forward or reverse directions. A propeller 21 is affixed to the end of the propeller shaft 19 for powering the associated watercraft in a well known manner.

A steering shaft 22 is affixed by upper and lower brackets to the drive shaft housing 16 and is journalled for steering movement about a generally vertically extending steering axis within a swivel bracket 25. The swivel bracket 25 is, in turn, pivotally connected to a clamping bracket 26 by means of a horizontally extending pivot pin 27 for tilt and trim movement of the outboard motor 11, as is well known in this art. The clamping bracket 26 includes a clamping assembly for affixing the outboard motor 11 to a transom of an associated watercraft.

The construction of the engine 12 and particularly its induction system, which forms the principal portion of the invention, will now be described in detail by particular reference to FIGS. 2 and 3. In this embodiment, the engine 12 is of the V6 type and has a pair of cylinder banks 31 and 32 each of which forms three cylinders. The cylinder banks 31 and 32 are formed in primary part by a cylinder block 33 in which the cylinder bores are formed. The cylinder banks 31 and 32 are disposed at a V-angle and define a valley 34 therebetween.

Each cylinder bank, 31 and 32 is provided with cylinder bores 35 which are formed by pressed or cast in cylinder liners 36. Pistons 37 reciprocate in these cylinder bores 35 are connected by means of connecting rods 38 to a crankshaft 39. The crankshaft 39 is rotatably supported about a vertical axis within a crankcase formed by a skirt of the cylinder block 33 and a crankcase member 41 that is affixed to the cylinder block 33 in a well known manner. The interior of the crankcase is divided into a plurality of chambers 42 which are sealed from each other, each of which communicates with a respective one of the cylinder bores 35.

A cylinder head assembly, indicated generally by the reference numeral 43 is affixed to each bank, 31 and 32 of the cylinder block 33 and has individual recesses 44 which cooperate with the cylinder bores 35 and heads of the pistons 37 to form the combustion chambers. Spark plugs 45 are mounted in the cylinder heads 43 and have their gaps extending into the respective recesses 44 for firing the charge admitted thereto in a well known manner.

The construction of the engine 12, as thus far described, may be considered to be conventional and, for that reason, further details of its internal construction are not believed to be necessary to understand the construction and operation of the invention. It should be noted, however, that as is typical with two cycle outboard motor practice, the crankcase chambers 42 are provided at the front of the engine and adjacent the transom of the watercraft 29. This is so as to position the driveshaft at a forward location to improve the balance and compactness of the outboard motor 11.

With conventional type of outboard motors having this configuration, the induction system that delivers the fuel/air charge to the crankcase chambers 42 is positioned at the front of the engine and communicates with the chambers 42 directly through the crankcase member 41. As should be readily apparent, this arrangement will cause the intake charge to flow rearwardly into the crankcase chambers 42. However, as the outboard motor 11 is trimmed up about the pivot pin 27, the intake charge must then flow uphill. As a result, any fuel condensation which occurs in the induction system will cause the fuel to puddle at the upstream side of the induction system. When the outboard motor 11 is trimmed down or when the outboard motor 11 is accelerated, this puddled fuel will tend to flow backwardly into the induction system and into the crankcase chambers 42 to provide an overrich mixture with the obvious disadvantages.

In accordance with the invention, therefore, an induction system, indicated generally by the reference numeral 46, is provided for the engine 12 which is positioned in the valley 34 between the cylinder banks 31 and 32 and which communicates with the crankcase chambers 42 at their rearward rather than at their forward sides. The flow from the induction system 46 to the chambers 42 also flows in a forward direction rather than in a rearward direction, as with the prior art type of constructions.

Figure 2:
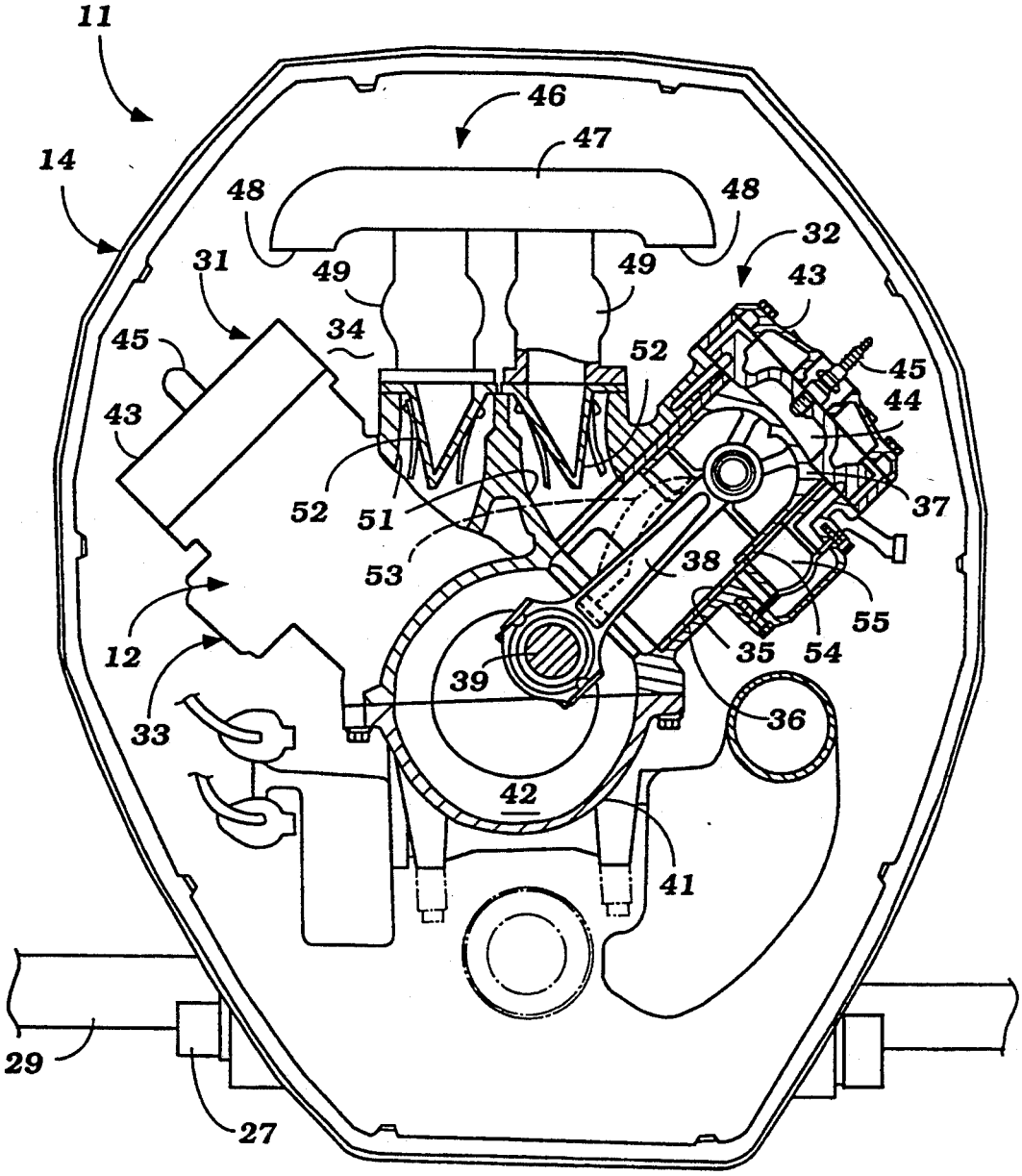
FIG. 2 is an enlarged top plan view of the power head of the outboard motor with a portion of the protective cowling removed and with a part of the engine broken away and shown in section.
Figure 3:
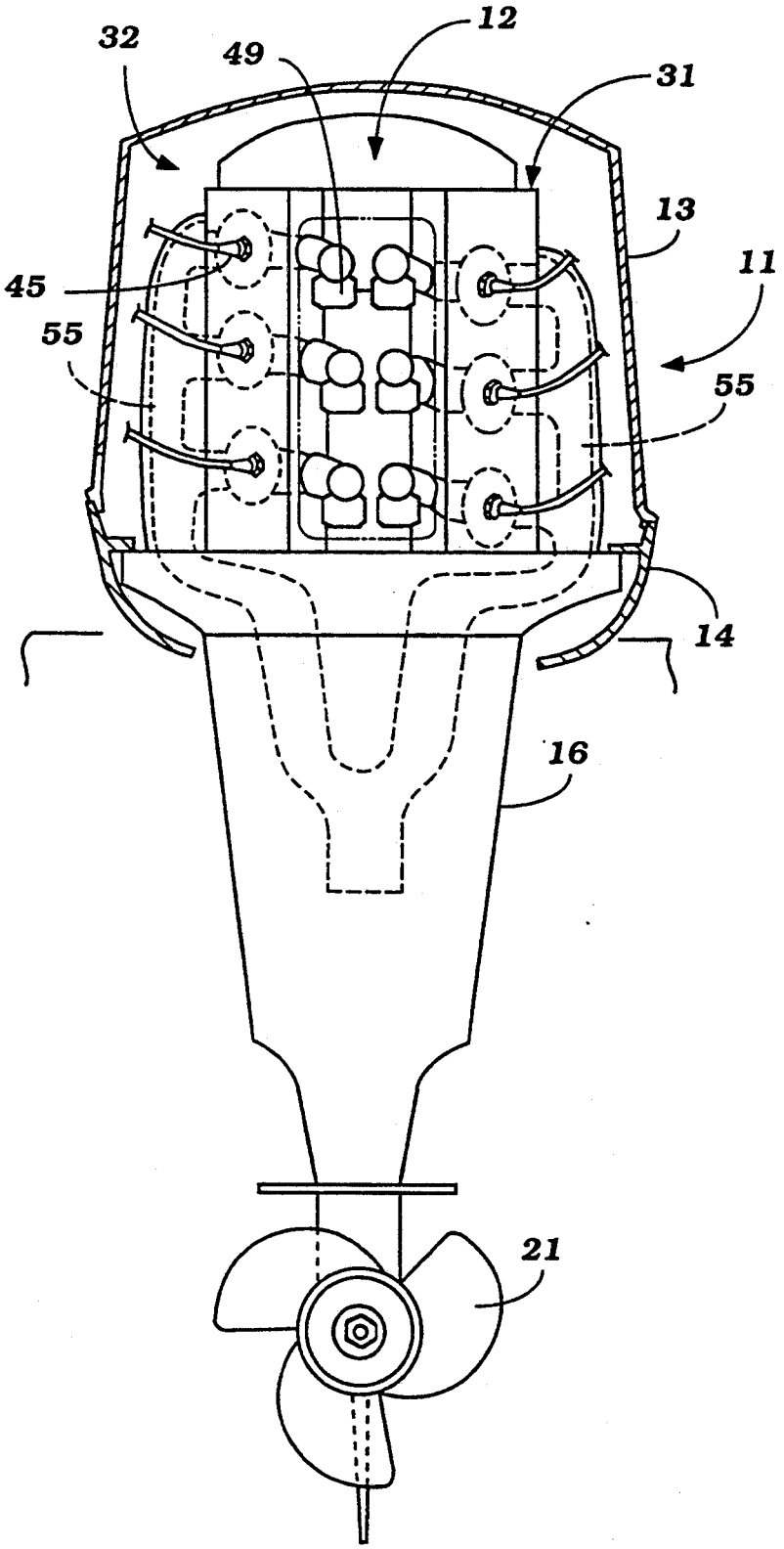
FIG. 3 is a rear plan view of the outboard motor, on a scale enlarged slightly from FIG. 1, with a portion of the protective cowling broken away.

The induction system 46 includes an air intake and silencer device 47 which has a generally U-shaped configuration with forwardly extending intake openings 48 that draw air from the interior of the protective cowling, as may be seen in FIG. 2 wherein the main cowling member 43 is removed.

The intake device 47 supplies air to a series of horizontally disposed side draft carburetors 49 which, in turn, deliver their fuel/air charge to pairs of generally parallel extending intake ports 51 formed in the cylinder block 33, each communicating with a respective crankcase chamber 42 of the respective cylinder banks 31 and 32 through the cylinder block 33. Reed type check valves 52 are positioned in the intake ports 51 so as to permit flow in a forward direction from the carburetors 49 into the crankcase chambers 42 when the pistons 37 are moving upwardly and for precluding reverse flow when the pistons 37 move downwardly to compress the fuel/air charge within the crankcase chambers 42.

The charge drawn into and compressed within the crankcase chambers 42 is transferred to the combustion chamber formed by the cylinder head recess 44, the head of the piston 37 and cylinder bore 35 through one or more scavenge passages 53 which extending from the individual crankcase chambers 42 to the cylinder bores 35 in an area above the pistons 37. As the pistons 37 continue their upward stroke, this charge is further compressed and then fired by the spark plugs 45. The burnt charge then expands driving the pistons 37 downwardly and as the pistons 37 continue their downward movement, they open exhaust ports 54 formed in the cylinder liners 36 and the exhaust gases may flow to respective exhaust manifolds 55, each associated with a respective one of the cylinder banks 31 and 32. These exhaust gases are then discharged downwardly through the driveshaft housing 16 through a suitable exhaust system and terminate in a high speed underwater exhaust gas discharge (not shown) which may comprise a through-the-hub propeller type discharge. In addition and as is typical with outboard motor practice, a restricted above-the-water low speed exhaust gas discharge (not shown) may also be incorporated.

The invention, as thus far described, has been embodied in a V-type engine and in the specific illustrated embodiment one having six cylinders. Of course, it should be readily apparent to those skilled in the art that the invention may equally well be employed with engines having other cylinder numbers arranged in a V formation. The invention may also be employed in conjunction with inline engines of any numbers of cylinders and FIGS. 4 and 5 show the application of the invention to such an embodiment.

Figure 4:
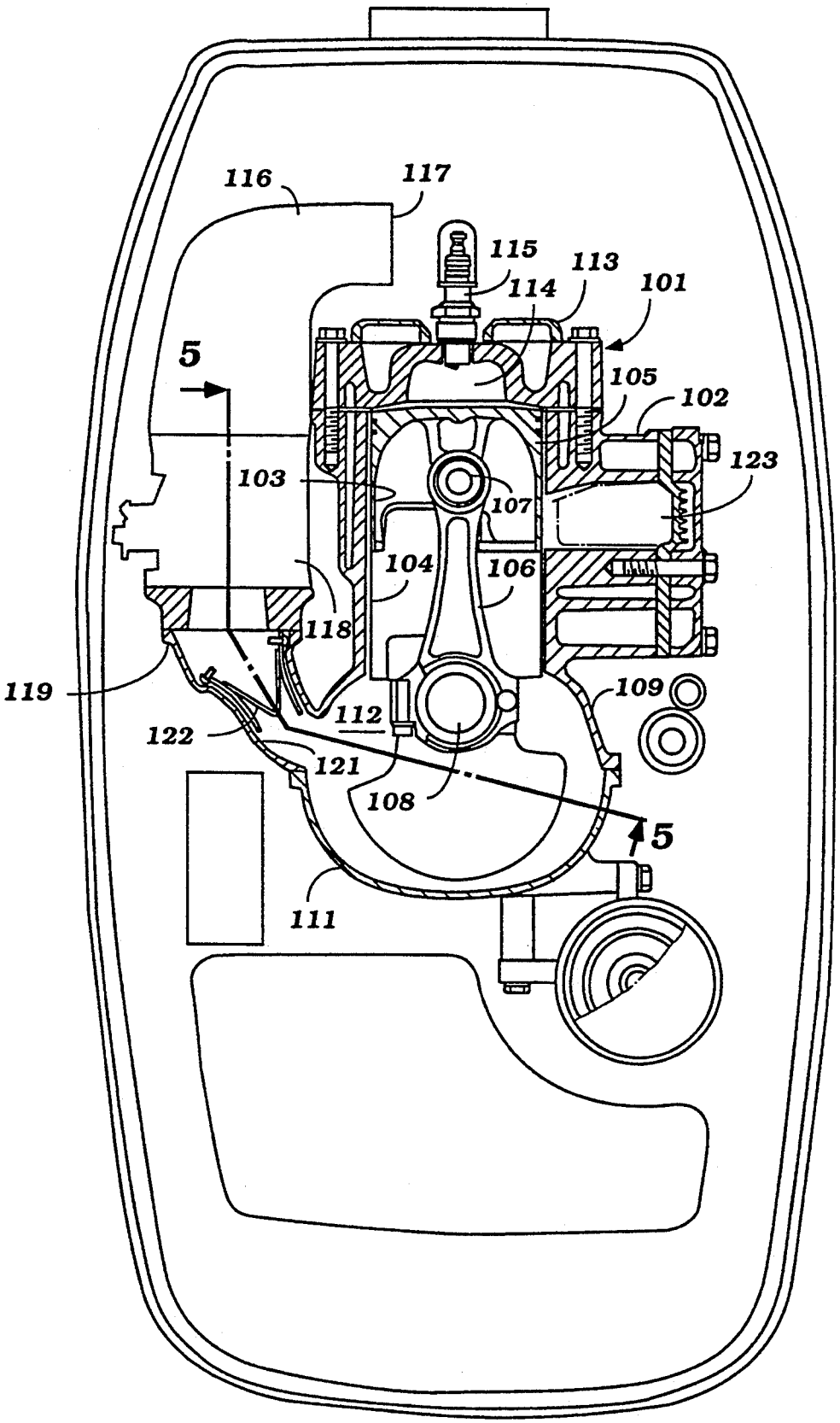
FIG. 4 is a top plan view, in part similar to FIG. 2, and shows another embodiment of the invention.
Figure 5:
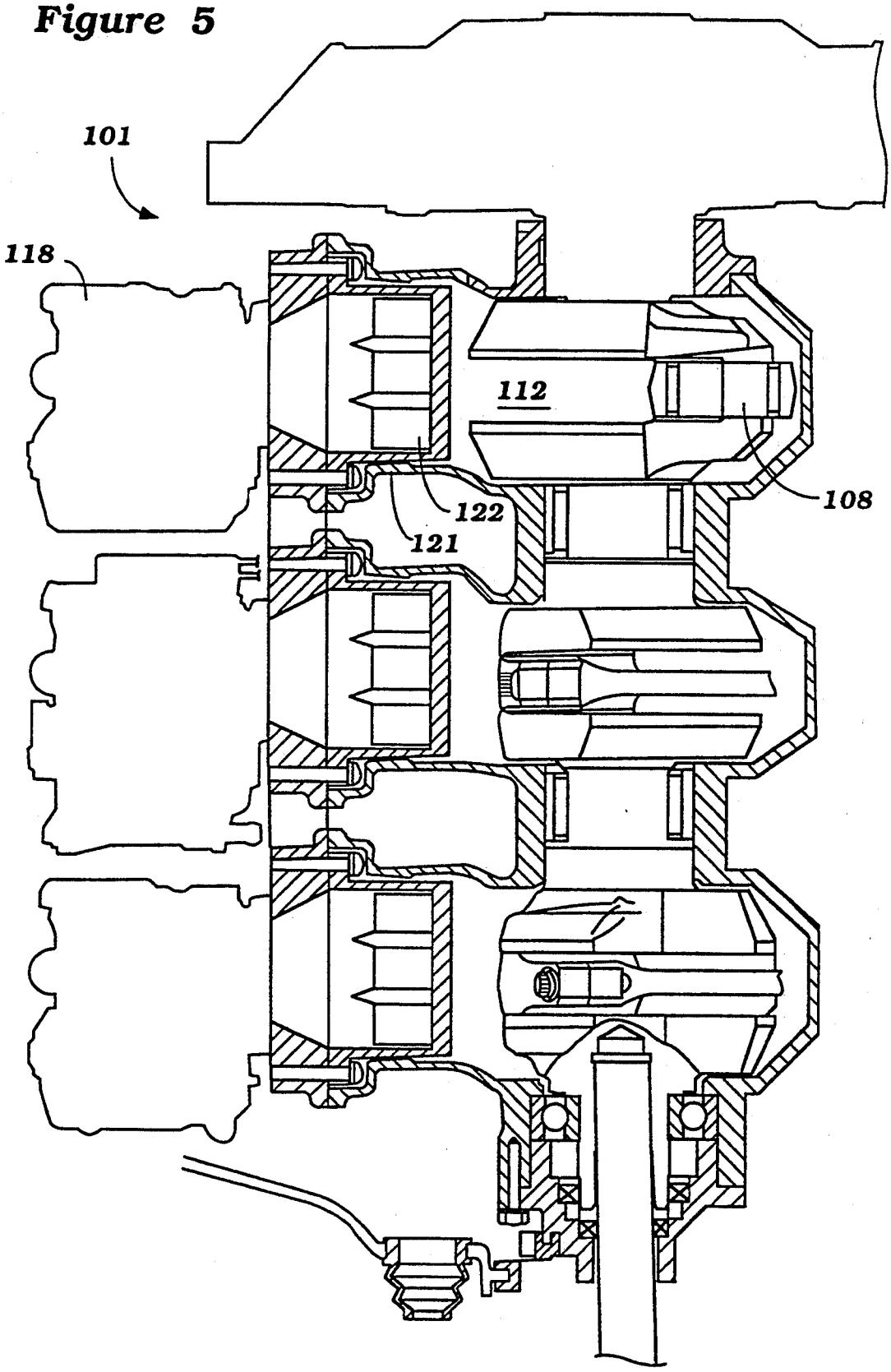
FIG. 5 is an enlarged cross sectional view taken along the line 5—5 of the embodiment of FIG. 4.

In FIGS. 4 and 5, only the engine, identified generally by the reference numeral 101, is shown in any detail since the basic construction of the outboard motor may be of the type previously described. The engine 101 includes a cylinder block 102 in which aligned cylinder bores 103 are formed by pressed or cast in cylinder liners 104. In the illustrated embodiment, there are three such cylinder bores.

Pistons 105 are supported for reciprocation within the cylinder bores 103 and are connected to the small ends of connecting rods 106 by means of pistons pins 107. The large end of the connecting rods 106 is journalled on a respective throw of a crankshaft 108. The crankshaft 108 is rotatably journalled within a crankcase formed by a skirt 109 of the cylinder block 102 and a crankcase member 111 that is affixed to the cylinder block 102 in any suitable manner. As is typical with two cycle engine practice and as has been previously noted, the crankcase chamber is divided into a plurality of chamber sections 112 which are sealed from each other and each of which is associated with a respective cylinder bore 103.

A cylinder head assembly, indicated generally by the reference numeral 113 is affixed to the cylinder block 102 in a suitable manner and is formed with recesses 114 which cooperate with each of the cylinder bores 103 and pistons 105 to form the variable volume chamber which comprises the combustion chamber. Spark plugs 115 are supported in the cylinder head assembly 113 and have their spark gaps extending into the respective recesses 114. The spark plugs 115 are fired by a suitable ignition system (not shown).

An induction system is provided for supplying a fuel-/air charge to the crankcase chamber sections 112 and this induction system includes an air inlet and silencer device 116 that is positioned at one side of the cylinder block 102 and cylinder head 113. The inlet device 116 has an inlet opening 117 which extends over the cylinder head 113 and draws air from within the protective cowling.

This air is then delivered to a charge former, in this embodiment a carburetor 118. As is typical with two cycle practice, there may be provided an individual carburetor 118 for each of the cylinder bores 103. The carburetors 118 discharge the fuel/air mixture into an intake manifold 119 which, in the illustrated embodiment, is formed integrally with the skirt portion 109 of the cylinder block 102 at one side thereof. This intake manifold 119 defines passages 121 which communicate with the crankcase chamber sections 112 at one side of the upper portion thereof. A reed type check valve 122 is positioned in each manifold passage 121 for permitting flow into the crankcase chamber sections 112 and for precluding reverse flow.

The charge which has been drawn into the crankcase chamber sections 112 during the upward movement of the pistons 105 is compressed as the pistons 105 move downwardly and then is transferred to the combustion chamber through one or more scavenge ports (not shown). The charge is then fired by the spark plugs 115 and discharged through an exhaust manifold 123 formed at the side of the engine opposite to the intake side.

It should be readily apparent from the foregoing description that the described embodiments of the invention provide an induction system for the engine of an outboard motor in which the intake passages extend from the front to the rear so as to be relatively unaffected by trim up and trim down of the outboard motor and by accellerations. Although the invention has been described in conjunction with carbureted engines, it should be readily apparent that it can be also incorporated with fuel injected engines. It is to be understood that the foregoing description is that of preferred embodiments of the invention and various changes and modifications may be made without departing from the spirit and scope of the invention, as defined by the appended claims.

We claim:

1. An outboard motor adapted to be affixed for tilt and trim movement about a horizontal axis at a forward point of said outboard motor relative to the hull of an associated watercraft, said outboard motor including a power head disposed generally above said horizontal axis and containing a two cycle, crankcase compression, internal combustion engine, said engine comprising a crankcase positioned forwardly in said power head and adapted to rotatably support a crankshaft, a cylinder extending generally rearwardly from said crankcase and containing a piston for driving a crankshaft, an intake port for admitting a charge to said crankcase, and an intake pipe connected at its outlet end to said intake port and extending generally rearwardly therefrom for delivering a charge flowing in a generally forward direction to said intake port and to said crankcase.

2. An outboard motor as set forth in claim 1 wherein the engine supported so that the crankshaft rotates about a generally vertically extending axis and drives a driveshaft extending through a driveshaft housing positioned at the lower end of the power head for driving a propulsion device for powering the associated hull.

3. An outboard motor as set forth in claim 2 further including means for admitting fuel to the intake pipe.

4. An outboard motor as set forth in claim 3 wherein the fuel is admitted to the intake pipe at a position spaced rearwardly from the intake port.

5. An outboard motor as set forth in claim 4 wherein the means for delivering fuel to the intake pipe comprises a carburetor positioned to the rear of said intake port at an inlet end of the intake pipe.

6. An outboard motor as set forth in claim 1 wherein the engine is provided with a cylinder block having plurality of cylinders and pistons each driving the crankshaft, said intake port being formed in said cylinder block.

7. An outboard motor as set forth in claim 6 wherein the cylinders are disposed at an angle to the crankcase to provide a V-type of engine.

8. An outboard motor as set forth in claim 7 wherein the cylinders define a valley on the rear side of the engine.

9. An outboard motor as set forth in claim 8 wherein the intake ports and intake pipes for the engine are disposed in the valley between the cylinder banks.

10. An outboard motor as set forth in claim 9 wherein the engine supported so that the crankshaft rotates about a generally vertically extending axis and drives a driveshaft extending through a driveshaft housing positioned at the lower end of the power head for driving a propulsion device for powering the associated hull.

11. An outboard motor as set forth in claim 10 further including means for admitting fuel to the intake pipe.

12. An outboard motor as set forth in claim 11 wherein the fuel is admitted to the intake pipe at a position spaced rearwardly from the intake port.

13. An outboard motor as set forth in claim 12 wherein the means for delivering fuel to the intake pipe comprises a carburetor positioned to the rear of said intake port at an inlet end of the intake pipe.

14. An outboard motor as set forth in claim 6 wherein the cylinders are disposed in an inline condition.

15. An outboard motor as set forth in claim 14 wherein the intake ports are formed at one side of the crankcase.

16. An outboard motor as set forth in claim 15 wherein the engine supported so that the crankshaft rotates about a generally vertically extending axis and drives a driveshaft extending through a driveshaft housing positioned at the lower end of the power head for driving a propulsion device for powering the associated hull.

17. An outboard motor as set forth in claim 16 further including means for admitting fuel to the intake pipe.

18. An outboard motor as set forth in claim 17 wherein the fuel is admitted to the intake pipe at a position spaced rearwardly from the intake port.

19. An outboard motor as set forth in claim 18 wherein the means for delivering fuel to the intake pipe comprises a carburetor positioned at the inlet end of the intake pipe.

20. An outboard motor adapted to be affixed for tilt and trim movement at a forward point of said outboard motor relative to the hull of an associated watercraft, said outboard motor including a power head containing a two cycle, crankcase compression, internal combustion engine, said engine comprising a crankcase positioned forwardly in said power head and adapted to rotatably support a crankshaft, a pair of angularly disposed cylinders extending generally rearwardly from said crankcase and each containing a piston for driving a crankshaft, said cylinders defining a valley therebetween, intake port means in said valley for admitting a charge to said crankcase, and intake pipe means in said valley and connected at its outlet end to said intake port means and extending generally rearwardly therefrom in said valley for delivering a charge flowing in a forward direction to said crankcase.

21. An outboard motor as set forth in claim 20 wherein the engine supported so that the crankshaft rotates about a generally vertically extending axis and drives a driveshaft extending through a driveshaft housing positioned at the lower end of the power head for driving a propulsion device for powering the associated hull.

22. An outboard motor as set forth in claim 21 further including means within said valley for admitting fuel to the intake pipe means.

23. An outboard motor as set forth in claim 22 wherein the fuel is admitted to the intake pipe at a position spaced rearwardly from the intake port.

24. An outboard motor as set forth in claim 23 wherein the means for delivering fuel to the intake pipe comprises a carburetor positioned at the inlet end of the intake pipe means.

* * * * *